US006595391B1

(12) United States Patent
Anderson

(10) Patent No.: US 6,595,391 B1
(45) Date of Patent: Jul. 22, 2003

(54) ASEPTIC LIQUID PACKAGING FITMENT

(75) Inventor: Ian Anderson, Warneet (AU)

(73) Assignee: Rapak Asia Pacific Ltd., Ellerslie (NZ)

( * ) Notice: Subject to any disclaimer, the term of this patent is extended or adjusted under 35 U.S.C. 154(b) by 0 days.

(21) Appl. No.: 09/857,487

(22) PCT Filed: Dec. 7, 1999

(86) PCT No.: PCT/AU99/01087

§ 371 (c)(1),
(2), (4) Date: Jun. 6, 2001

(87) PCT Pub. No.: WO00/34136

PCT Pub. Date: Jun. 15, 2000

(30) Foreign Application Priority Data

Dec. 7, 1998 (AU) ..... PP 7573

(51) Int. Cl.[7] ..... B67D 5/00

(52) U.S. Cl. ..... 222/83.5; 222/105; 222/107; 222/153.06; 53/468

(58) Field of Search ..... 53/468; 222/81, 222/83, 83.5, 105, 107, 153.06

(56) References Cited

U.S. PATENT DOCUMENTS 4,446,673 A * 5/1984 Desthieux ..... 222/105
4,805,378 A * 2/1989 Anderson ..... 53/426
4,893,733 A * 1/1990 Thomsen ..... 222/559
4,999,978 A * 3/1991 Kohlbach et al. ..... 53/512
5,029,432 A * 7/1991 Loeliger ..... 53/469
5,099,895 A * 3/1992 Loeliger ..... 141/89

FOREIGN PATENT DOCUMENTS

WO WO 9110598 A * 7/1991 ..... B60P/7/16

* cited by examiner

*Primary Examiner*—Kenneth Bomberg
(74) *Attorney, Agent, or Firm*—Cahn & Samuels, LLP

(57) ABSTRACT

An aseptic container (10) for use in aseptic packaging system, said container having a wall (12) which encloses a volume in which the material to be packaged will be received, a generally cylindrical gland (14) fitted to said wall, said gland having an inner sealing surface (22) which is in communication with said volume, and an outer sealing surface (28), and a passage (16) through the gland, the inner and outer sealing surfaces (22, 28) extending around said passage (16), an inner sealing membrane (24) adapted to seal with said inner sealing face (22) of the gland, an outer sealing membrane (30) adapted to seal said outer sealing face (28) of the gland, and connection formations (32) formed on the gland for securing a filling or dispensing head or nozzle (34) to the gland in use, wherein said outer sealing membrane (30) being secured to a collar (18) that is adapted to be secured to said gland (14) via said connection formations (32).

15 Claims, 4 Drawing Sheets

ASEPTIC LIQUID PACKAGING FITMENT

FIELD OF THE INVENTION

This invention relates to an aseptic packaging system, more specifically to a method of aseptically filling a container and to a container for use in that method.

BACKGROUND OF THE INVENTION

Where it is desired to fill a sterilised container with flowable materials such as foodstuffs or the like it is important that bacteria and other micro organisms are not introduced into the container during the filling process. Also, once filling has been completed, it is important that the container is sealed in such a manner that contaminants are not able to enter the container during transportation or storage through the sealed filling inlet.

Various prior art patents have addressed the aforementioned problems and reference may be made to U.S. Pat. No. 4,805,378 (Anderson), U.S. Pat. No. 2,930,170 (Holdsman et al), U.S. Pat. No. 4,542,530 (Thomas et al) and U.S. Pat. No. 4,672,688 (Kalipsarkis). These prior art patents describe systems, which are successful to a greater or lesser extent. However, the prior art systems do suffer from deficiencies, at least under some filling circumstances.

For example, U.S. Pat. No. 4,805,378 discloses an arrangement in which a membrane is positioned across the mouth of the filling inlet, which is pierced during the filling process. Generally this piercing is achieved by a cutting head which makes a pair of straight incisions, crossed at right angles, passing through the centre of the membrane and extending radially outwards to a point just inside the outer flange of the upstanding gland or collar. Accordingly, as the liquid or liquid like product flows into the bag container to fill it, the four cut tips or "petals" of the membrane turn inwardly with the flow and extend towards the inner end of the collar where it is connected to the container in the region that it subsequently sealed as described in the patent specification. This arrangement is sometimes unreliable in that the four petals are difficult to clean underneath to remove remnants of the packaged product inside the collar during the flushing cycle. Also, the petals tend to reduce the flow rate of product into the container during the filling, which can be disadvantageous from a production point of view with viscous or particulate containing products.

There is furthermore a risk that the tips of the petals might wrap underneath the inside corner of the collar and be caught up in the subsequent final heat sealing operation. If this were to happen there would be potential for a leakage path to bypass the seal or, at least, a potential source of failure of the seal.

There is a further requirement of the industry to have an appropriate arrangement for connecting decanting equipment to the filling gland or collar. The aforementioned petals often serve as an impediment to subsequent use of the fitment for attachment of recloseable closures and other devices for dispensing the product by the end user, and also prevent close inspection of the inner sealed membrane for cleanliness and sealing performance. Many commercial tap and dispensing systems incorporate a standard female thread form in their attachment means and many have been derived from systems used on commercial rigid containers such as plastic bottles. It is desirable to be able to fit these standard commercially available dispensing systems to an aseptic outlet port without modification of the connection arrangement.

SUMMARY OF THE INVENTION

The invention provides an aseptic container for use in an aseptic packaging system, said container comprising a wall which encloses a volume in which the material to be packaged will be received, a generally cylindrical gland fitted to said wall, said gland having an inner sealing surface which is in communication with said volume, and an outer sealing surface, and a passage through the gland, the inner and outer sealing surfaces extending around said passage, an inner sealing membrane adapted to seal with said inner sealing face of the gland, an outer sealing membrane adapted to seal said outer sealing face of the gland, and connection formations formed on the gland for securing a filling or dispensing head or nozzle to the gland in use.

The invention also provides an aseptic container for use in an aseptic packaging system, said container having a wall which encloses a volume in which the material to be packaged will be received, a generally cylindrical gland fitted to said wall, said gland having an inner sealing surface which is in communication with said volume, and an outer sealing surface, and a passage through the gland, the inner and outer sealing surfaces extending around said passage, an inner sealing membrane adapted to seal with said inner sealing face of the gland, an outer sealing membrane adapted to seal said outer sealing face of the gland, and connection formations formed on the gland for securing a filling or dispensing head or nozzle to the gland in use, wherein said outer sealing membrane being secured to a collar that is adapted to be secured to said gland via said connection formations.

The connection formations are preferably screw threads, preferably on the outer surface of the gland.

Preferably the first sealing membrane is the form of a flap which is partially secured to the inside face of the gland and which is adapted to be welded or otherwise secured to the inside face after the container has been filled with a selected filling material.

The outer sealing membrane can either be secured to the outside face of the gland or may be secured to a collar which is adapted to be screwed onto said threads. Optionally said collar may be sealed to said gland by a bevelled engaging sealing surface, an elastomeric gasket, a sealing compound, heat sealing, or some other sealing arrangement for ensuring a contamination free seal.

Screw threads are preferably formed on the outer face of the gland, which have a pitch and configuration suitable for receiving a conventional tap or other dispensing system.

According to the second aspect of the invention there is provided a method of a subject filling a container which comprises the steps of:

- providing a container with a filling gland having an inner sealing surface to which a inner sealing membrane is partially secured, and an outer sealing surface to which a outer sealing membrane is sealed, a passage passing through said gland, and either external or internal screw threads formed on said gland;
- bringing a filling head into engagement with the gland and sterilising the outer surface of the outer membrane;
- piercing the outer membrane and filling the container with a selected material; and
- sealing the inner membrane by welding the inner membrane to the inner sealing surface.

Optionally the filling process may be completed by removing said filling head and screwing a cap or other closure onto said screw threads.

These and further features of the invention are made apparent from the description of two embodiments set out below by way of example. In the description references made to the accompanying drawings but the specific features shown in the drawings should not be construed as limiting on the invention.

DETAILED DESCRIPTION OF THE EMBODIMENTS

Figure 1:
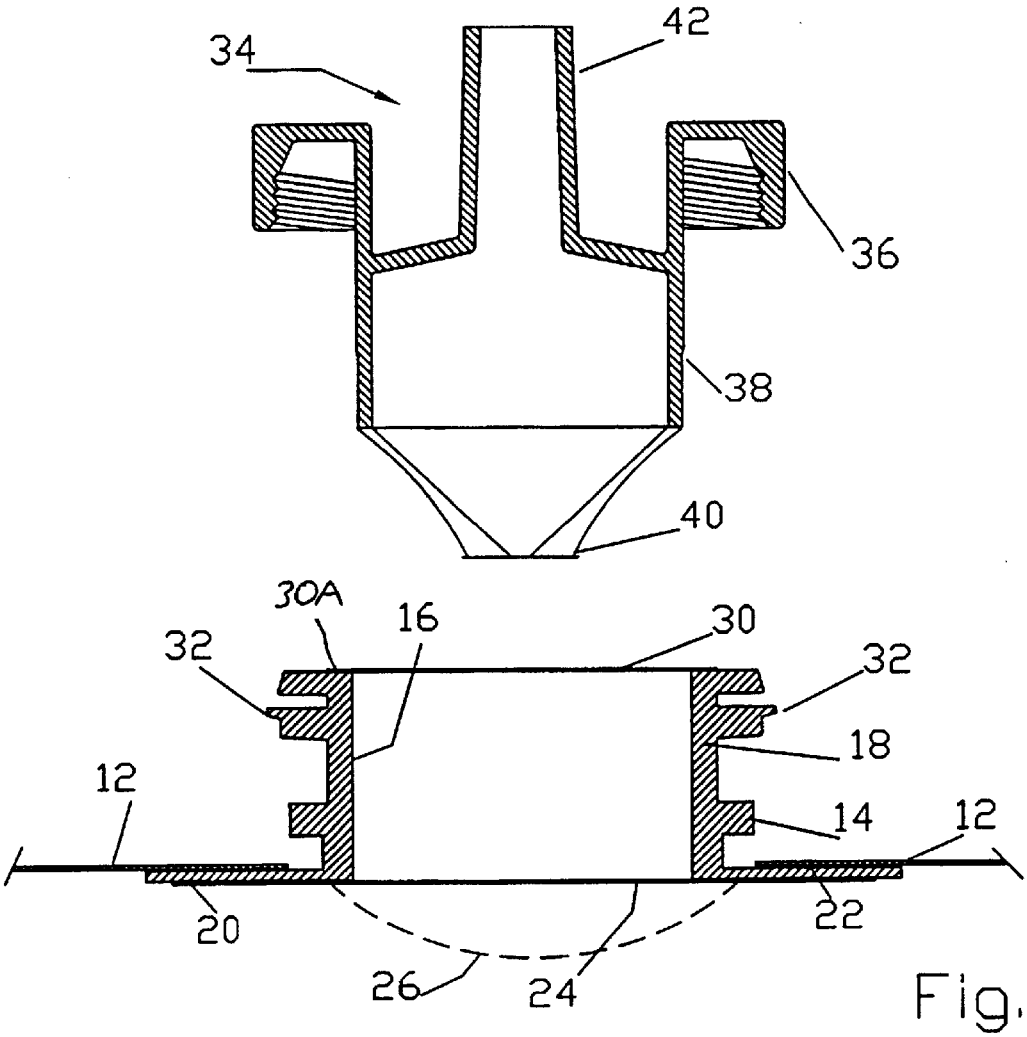
FIG. 1 shows a cross-sectional side view of a first embodiment of aseptic gland and dispensing nozzle according to the invention.
Figure 1A:
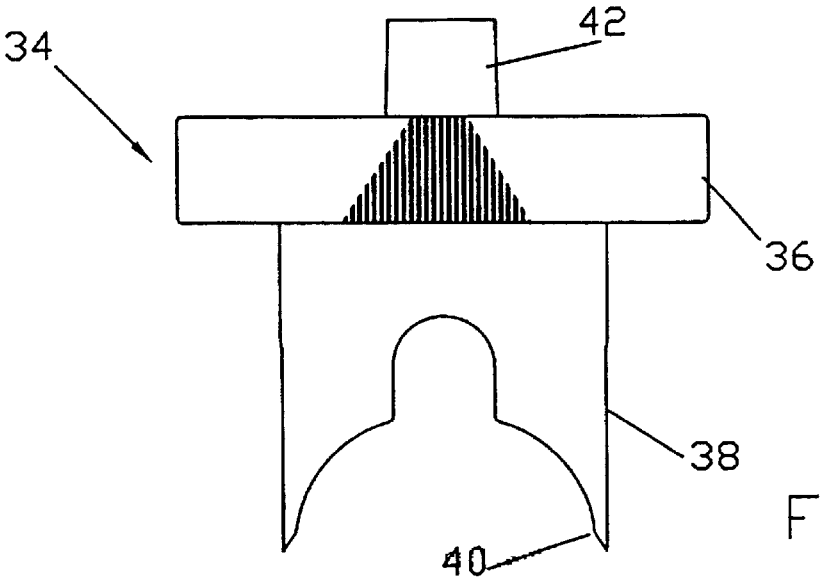
FIG. 1*a* shows a side view of the dispensing nozzle shown in FIG. 1.

Shown in FIG. 1, is part of an aseptic container 10 that has a wall 12 comprised of a flexible impervious membrane which is well known in the art and need not be described herein in any further detail.

A filling and dispensing gland 14 is mounted to the wall 12 to provide an opening through which a filling material may be introduced into the bag 10 and through which that material can be decanted or discharged as required by an end user. The gland 14 has a cylindrical passage 16 therethrough, which is defined by the inner wall of a generally cylindrical collar portion 18.

A flange 20 on an inner end of the collar 18 is welded to the wall 12 as shown to thereby secure the gland 14 to the wall 12. The inner face 22 of the flange 20 provides an inner sealing face for the gland 14. An inner membrane 24 is, prior to filling the container, partially adhered to the inner sealing face 22. During filling of the container 10 the membrane 24 may adopt a configuration indicated by dotted lines 26 to allow the material to pass through the gland 14 into the container.

The outer end 30A of the gland 14 has defined thereon a sealing face 28 to which an outer membrane 30 is bonded. At the time of manufacture, the interior of the container and the gland 14, that is, all regions inside of the membrane 30 are sterilised and the membrane 30 provides a barrier to the ingress of bacteria and like contaminants into the gland 14 and the container.

The gland 14 has screw threads 32 formed on the outer circumferential surface or radially outer face thereof. The screw thread 32 is configured to receive a discharge nozzle, which is indicated at numeral 34. Nozzle 34 is described in more detail below.

In order to fill the container a filling head (not shown) is brought into engagement with the gland 14 and a sterilisation fluid, normally steam, is applied to the outer face of the membrane 30 in order to sterilise that face. Thereafter the membrane 30 is pierced, usually in the form of a cross at the centre of the membrane. This cut configuration results in the pierced membrane 30 remaining fixed to the sealing surface 28 but cut into the form of four petals.

The filling head will then introduce the filling material into the container by passing that material through down the passage 16, and past the membrane 24, causing the membrane 24 to adopt the position as shown at numeral 26. After the container has been filled, the membrane 24 will be welded, or otherwise adhered, to the inner face 22 of the gland 14 around the periphery thereof, thereby sealing the container and preventing the filling material from leaking out through the gland and also preventing contaminants entering into the container past the membrane 24.

The filling head will then be removed from the gland 14 and, if desired, a closure cap (not shown) or the like may be applied to the gland 14 by screwing that cap onto the thread 32.

To discharge the filling material from the container an outlet nozzle of the type shown at numeral 34 may be used. That nozzle includes a threaded skirt 36, which is shaped and configured to screw onto the threads 32 on the gland 14. The nozzle furthermore includes a cutting tube 38, which is arranged to pierce the membrane 24. For this reason, the cutting tube 38 has cutting teeth 40 on the distal end thereof which will cut the membrane 24 as the threaded skirt 36 is screwed onto the screw thread 32.

The nozzle 34 furthermore includes an outlet nozzle or tube 42, which can be connected to a hose, tap, or other discharge arrangement. Thus, decanting the filled material from the container can be achieved by simply screwing the nozzle 34 onto the gland 14, which is sized to pierce the membrane 24 prior to engagement of the threads 36 with the thread 32 on gland 14. If desired the nozzle 34 could be sized so that the cutters 40 will only pierce the membrane 24 after the threads 36 and 32 have been engaged, that is the piercing occurs by the securing of the nozzle 34 on to the gland 14.

In either case, the piercing of the membrane 24 will immediately provide a flow communication with the interior of the container through which the filled material may be decanted. Clearly the threads 32 should be of a standard configuration so that a wide range of different fittings may be connected thereto provided the fittings are similarly provided with a female thread of standard configuration.

Turning now to FIGS. 2 to 9, a similar arrangement to that shown in FIG. 1 is depicted but which has certain additional advantages for certain applications. In this embodiment, components, which are similar to those already described with reference to the first embodiment, have been given the same numeral. As shown in FIGS. 2 to 9, the gland 14, instead of having an outer membrane adhered to the sealing face 28 thereof has a membrane 50, which is bonded to a separate collar 52.

Figure 2:
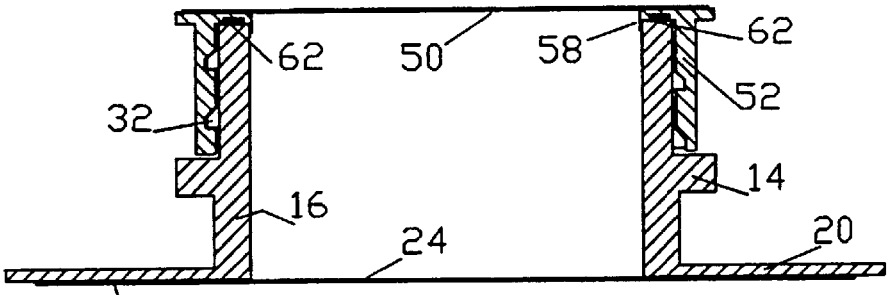
FIGS. 2 to 9 show cross-sectional side views of a second embodiment of the invention in different stages of the filling and dispensing operation.

The collar 52 has an internal female thread, which is adapted to screw onto the threads 32 of the gland 14. Thus, as shown in FIG. 2, the collar 52 with the membrane 50 bonded to the outer face 54 thereof will be screwed onto the gland 14 so that the internal passage 16 through the gland is sealed and free from contaminants at the time of manufacture of the container. The collar 52 may if necessary, be heat sealed onto the gland 14 or may have a frangible adhesive bonding the collar to the gland. In any event, it is important that a bacteria proof seal is provided between the gland 14 and the collar 52 to ensure that contaminants do not enter the passage 16 prior to the container being filled.

As shown in FIG. 2, a bevelled lip 58 is provided on the radially inner edge of a flange 60 provided on an outer end of the collar 52 to enhance this seal between the collar 52 and the gland 14. If necessary, an elastomeric gasket 62 may be provided on the inner face of the flange 60 to enhance the quality of the seal between the collar 52 and the gland 14.

Figure 3:
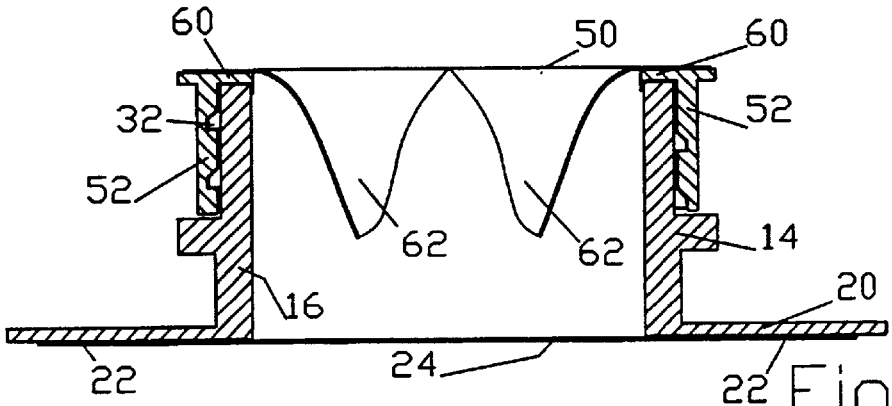
Figure 4:
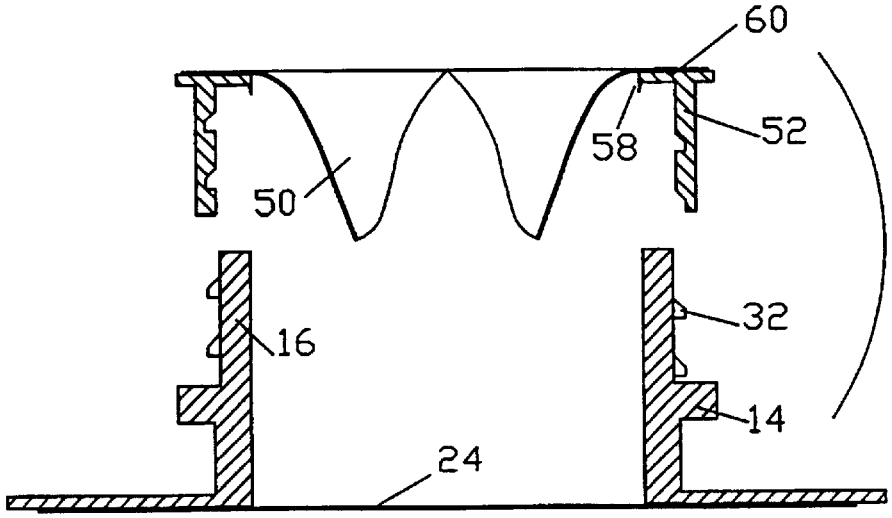
Figure 5:
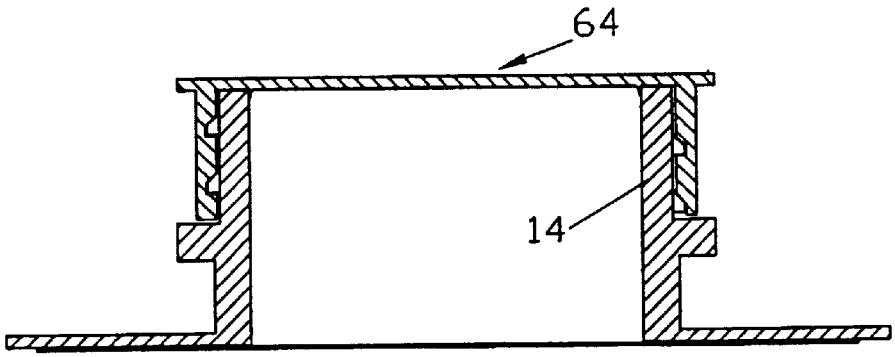
Figure 6:
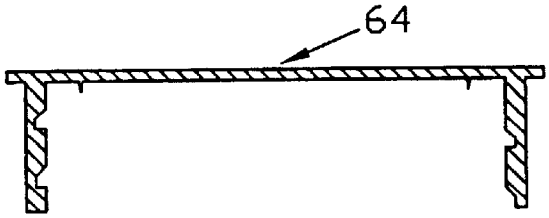

To fill the container the membrane 50 will be pierced, as was described above with reference to the previous embodiment, to form the four petals 62 as shown in FIG. 3 of the drawings. After the container has been filled, the inner membrane 24 will be sealed to the inner face 22 (as shown in FIG. 3) of the flange 20 in a manner previously described. Thereafter the collar 52 may be detached from the gland 14 as indicated in FIG. 3. A closure cap 64 as shown in FIG. 6 can be fitted to the gland 14 as shown in FIG. 5 to provide protection for the membrane 24 and also to prevent further contaminants entering into the passage 16.

Figure 7:
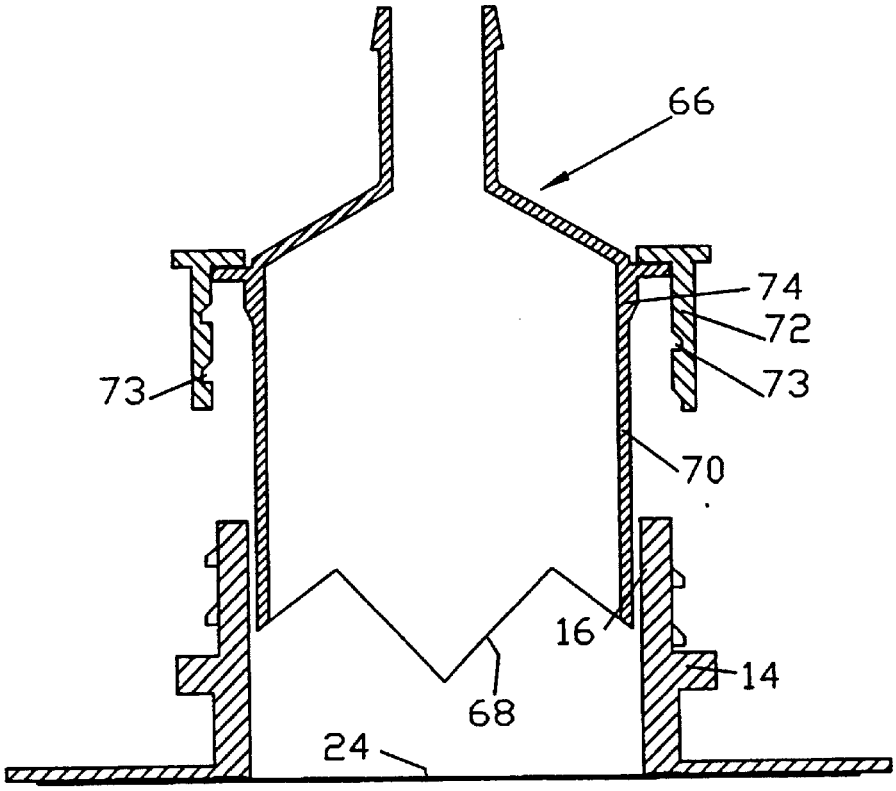
Figure 8:
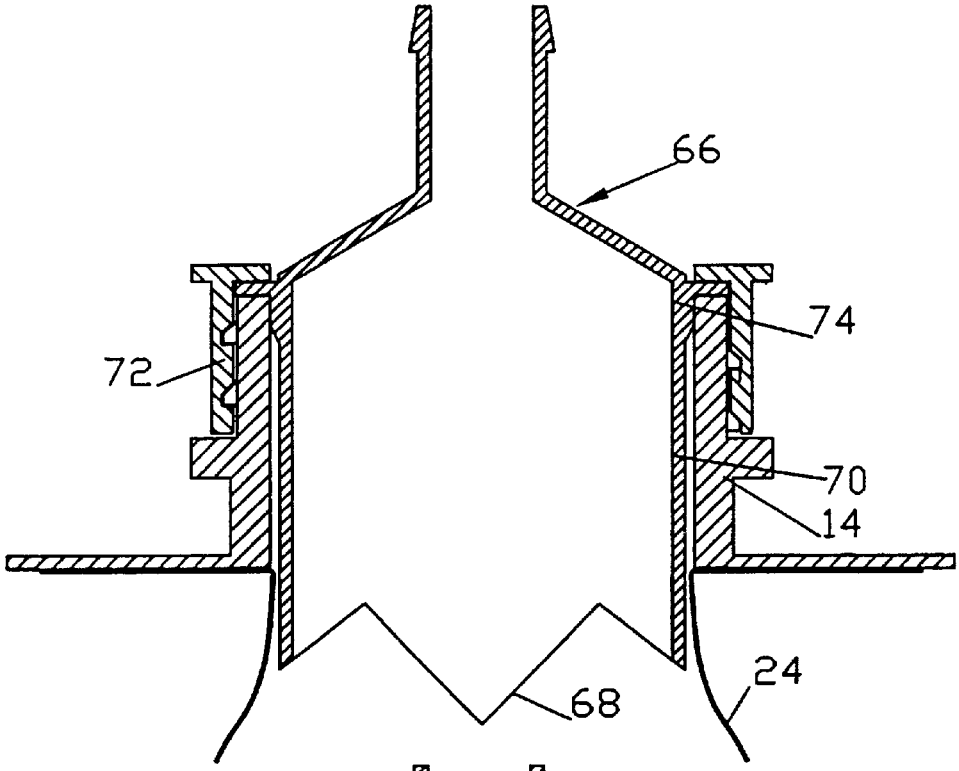
Figure 9:
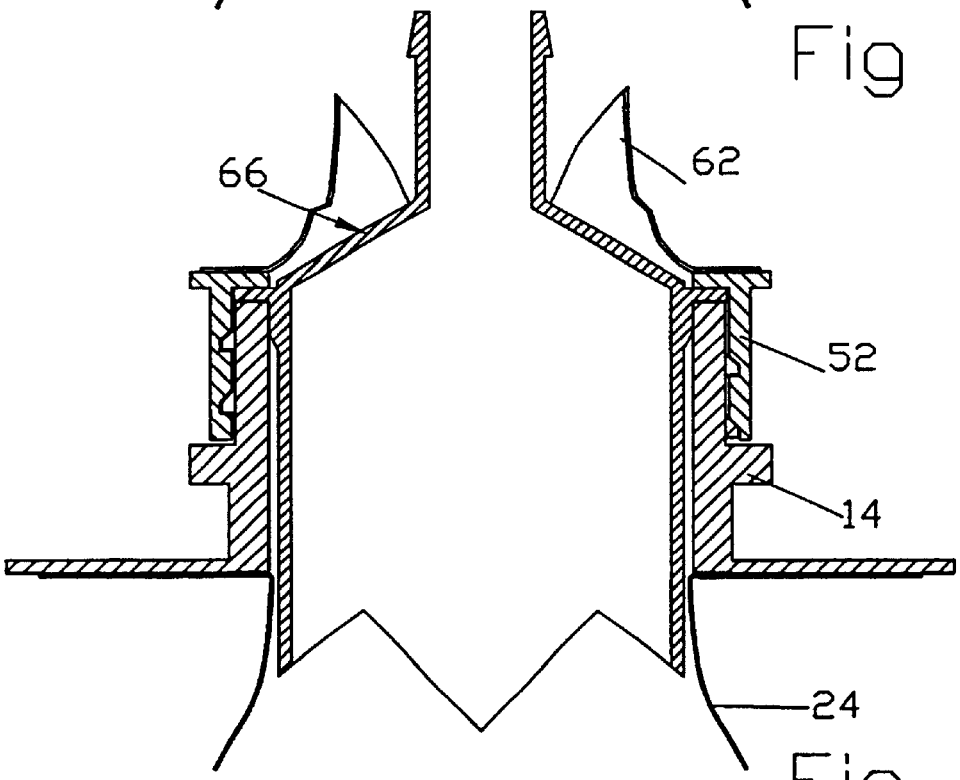

When it is desired to fit an outlet nozzle to the container this can be done in accordance with the arrangements shown in FIGS. 7 to 9 of the drawings. The outlet nozzle 66, which is in the formed of a stepped tube, may conveniently be used to create an outlet nozzle. The outlet nozzle 66 has cutting teeth 68 on the inner end thereof adapted to cut through the membrane 24. The nozzle includes a cylindrical skirt 70 which is adapted to be received within the passage 16 when decanting of the filling material is required.

To secure the nozzle 66 to the gland 14 a collar 72 having internal screw threads 73 can be used. The collar 72 secures the nozzle 66 in position in a manner similar to a union connection. This arrangement is shown in FIG. 8 of the drawings.

The collar 52, as described previously can be used instead of collar 72, to secure the nozzle in position, as shown in FIG. 9 of the drawings. The outlet nozzle 66 has an annular rib 74 extending around the periphery thereof to create a seal within the gland 14 when the outlet nozzle is secured within the gland 14 by the collar 72.

The collar 52, as can be seen from the figures, is able to keep the internal portions of the gland 14 in a sterilised state, but is also able to prevent damage to the thread 32 when the gland 14 is being handled or held by filling machines during the filling process. This is because the filling machine gripping members, and environmental conditions being generally hot in a sterilising environment, will engage or affect the flange 20 and can distort the thread 32 formation. Thus because contact is made with the external parts of the collar 52, only indirect pressure and heat will be exerted onto the thread 32 thus keeping thread 32 protected for later use when emptying the container via the fitments described above.

Another advantage of the collar 52 is that it is readily disposable after filling of the container via the gland 14, thus removing the petals and a source of contamination. The collar 52 is replaceable by a cap for hygienic purposes and or to reseal the container if it is opened and or to continue to protect the threads 32 during transport or use at an end users location.

The collar 52 and the embodiment above which utilises it can incorporate tamper proof or tamper indication devices or systems for the time prior to filling the container via the collar 52 and gland 14.

In use the containers 10 having the gland 14 and membrane 30 or collar 52 and membrane 50 mentioned above would first be assembled together and then sterilised by gamma radiation (or other suitable sterilisation process which is generally dependent upon the characteristics of the container, gland, and membrane material) to sterilise the volume of the container and the internal portions of the gland 14 and its attached collar 52 and membrane 50 or the membrane 30.

It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

What is claimed is:

1. An aseptic container for use in an aseptic packaging system, said container having a wall which encloses a volume in which the material to be packaged will be received, a generally cylindrical gland fitted to said wall, said gland having an inner sealing surface which is in communication with the volume, an outer sealing surface, and a passage, through the gland, said inner and outer sealing surfaces extending around said passage, an inner sealing membrane adapted to seal with said inner sealing face of said gland, an outer sealing membrane adapted to seal said outer sealing face of said gland, connection formations formed on said gland for securing a filling or dispensing head or nozzle to said gland in use, and a collar, and wherein said outer sealing membrane being secured to said collar that is adapted to be secured to said gland via said connection formations.

2. The aseptic container as claimed in claim 1, wherein said connection formations are on the outer surface of said gland.

3. The aseptic container as claimed in claim 2, wherein said connection formations include screw threads, said screw threads are formed on the outer face of said gland with a pitch and configuration suitable for receiving a conventional tap or other dispensing system, said inner sealing membrane is a flap partially secured to the inside face of said gland, said flap is secured to the inside face after the container has been filled with a selected filling material, said outer sealing membrane is secured to the outside face of said gland, and said collar is sealed to said gland by one of: a bevelled engaging sealing surface, an elastomeric gasket, a sealing compound, heat sealing, or some other sealing arrangement for ensuring a contamination free seal.

4. The aseptic container as claimed in claim 2, wherein said outer sealing membrane is secured to the outside face of said gland, said collar is sealed to said gland by one of: a bevelled engaging sealing surface, an elastomeric gasket, a sealing compound, heat sealing, or some other sealing arrangement for ensuring a contamination free seal.

5. The aseptic container as claimed in claim 1, wherein said connection formations are screw threads.

6. The aseptic container as claimed in claim 5, wherein said screw threads are formed on the outer face of said gland with a pitch and configuration suitable for receiving a conventional tap or other dispensing system.

7. The aseptic container as claimed in claim 5, wherein said outer sealing membrane is secured to the outside face of said gland, said collar is sealed to said gland by one of: a bevelled engaging sealing surface, an elastomeric gasket, a sealing compound, heat sealing, or some other sealing arrangement for ensuring a contamination free seal.

8. The aseptic container as claimed in claim 7, wherein said screw threads are formed on the outer face of said gland with a pitch and configuration suitable for receiving a conventional tap or other dispensing system.

9. The aseptic container as claimed in claim 1, wherein said inner sealing membrane includes a flap partially secured to the inside face of said gland.

10. The aseptic container as claimed in claim 9, wherein said flap is adapted to be welded or otherwise secured to the inside face after the container has been filled with a selected filling material.

11. The aseptic container as claimed in claim 10, wherein said outer sealing membrane is secured to the outside face of said gland.

12. The aseptic container as claimed in claim 9, wherein said outer sealing membrane is secured to the outside face of said gland, said collar is sealed to said gland by one of: a bevelled engaging sealing surface, an elastomeric gasket, a sealing compound, heat sealing, or some other sealing arrangement for ensuring a contamination free seal.

13. The aseptic container as claimed in claim 1, wherein said outer sealing membrane is secured to the outside face of said gland.

14. The aseptic container as claimed in claim 1, wherein said collar is sealed to said gland by one of: a bevelled engaging sealing surface; an elastomeric gasket; a sealing compound; heat sealing; or some other sealing arrangement for ensuring a contamination free seal.

15. The aseptic container as claimed in claim 1, wherein said connection formations include screw threads, said screw threads are formed on the outer face of said gland with a pitch and configuration suitable for receiving a conventional tap or other dispensing system, said first sealing membrane is a flap partially secured to the inside face of said gland, said flap is secured to the inside face after the container has been filled with a selected filling material, said outer sealing membrane is secured to the outside face of said gland, and said collar is sealed to said gland by one of: a bevelled engaging sealing surface, an elastomeric gasket, a sealing compound, heat sealing, or some other sealing arrangement for ensuring a contamination free seal.

* * * * *